United States Patent [19]

Bergstein

[11] 4,083,486

[45] Apr. 11, 1978

[54] CARTON WITH SIFT-PROOF END CLOSURE

[75] Inventor: Frank D. Bergstein, Cincinnati, Ohio

[73] Assignee: Bergstein Packaging Trust, Middletown, Ohio

[21] Appl. No.: 827,553

[22] Filed: Aug. 25, 1977

[51] Int. Cl.[2] ..... B65D 5/02

[52] U.S. Cl. ..... 229/37 R; 229/48 T

[58] Field of Search ..... 229/37 E, 37 R, 48 T, 229/DIG. 4

[56] References Cited

U.S. PATENT DOCUMENTS

| | | | |
|---|---|---|---|
| 2,322,654 | 6/1943 | Moore | 229/48 T UX |
| 2,596,224 | 5/1952 | Eaton et al. | 229/37 R |
| 3,191,847 | 6/1965 | Moore | 229/37 R |
| 3,746,244 | 7/1973 | Bergstein | 229/37 R |
| 3,981,432 | 9/1976 | Bergstein et al. | 229/37 R |

*Primary Examiner*—Davis T. Moorhead

*Attorney, Agent, or Firm*—Melville, Strasser, Foster & Hoffman

[57] ABSTRACT

A carton end closure in which an inner pair of closure flaps is provided with score lines extending parallel to and in close proximity to the inner edges of the closure flaps, the score lines defining grooves in the outer surfaces of the flaps, the inner flaps also being provided with trough defining debossed areas, preferably of triangular configuration, extending from the outer ends of the score lines to the inner corner edges of the inner flaps, a full width intermediate closure flap adapted to overlie the innermost flaps, the intermediate flap having score lines formed therein positioned to mate with the score lines in the inner flaps, so that when the flaps are infolded with a thin layer of adhesive interposed between the inner and intermediate flaps and sealing pressure applied, increments of adhesive will be forced into the troughs to form plugs which close and seal the corner edges of the end closure.

7 Claims, 8 Drawing Figures

CARTON WITH SIFT-PROOF END CLOSURE

This invention relates to paperboard cartons and more particularly to a seal end carton having scored and embossed end closure flaps which provide a sift-proof end closure.

BACKGROUND OF THE INVENTION

The present invention constitutes an improvement on the end closure constructions taught in U.S. Pat. No. 3,746,244, issued July 17, 1973, entitled "Sift-Proof Carton Construction", and U.S. Pat. No. 3,981,432, issued Sept. 21, 1976, entitled "Carton With Tightly Sealed End Closures".

The first of the aforementioned patents teaches an improved sift-proof carton construction wherein a plurality of the carton end closure flaps are provided with mating sets of ridges or grooves which interengage when the flaps are juxtaposed and sealed together, thereby providing barriers acting to prevent the sifting and leakage of powdered or granular materials from between the end closure flaps. The ridges or grooves are defined in the carton flaps by scoring rules similar to those employed to define the hinge lines connecting the various wall panels and end closure flaps to each other. The scoring rules effectively emboss the boxboard, defining a groove on the side of the board contacted by the rule and a ridge on the opposite side of the board. The positioning of the ridges and grooves is such that they will mate when the flaps are closed and sealed, thereby providing barriers which effectively prevent sifting and leakage of the contents from between the flaps.

The second of the above mentioned patents teaches ways of further enhancing the sift-proof character of the end closures utilizing opposing pairs of innermost end closure flaps which are folded upon themselves to form double thickness flap members adapted to enter into wedging engagement with the score lines by means of which the flaps are hingedly connected to the carton body walls. In order to insure tight sealing at the corners of the end closures, the double thickness flap parts are provided at their innermost ends with relatively small laterally projecting ears which, when the flaps are infolded and sealed, wedge in the corners of the cartons, thereby acting to close and seal "pin-holes" or interstices which may exist at the corners of the carton.

The present invention relates to a simplified way of sealing "pin-holes" and interstices which may form at the corner edges of the carton.

SUMMARY OF THE INVENTION

In accordance with the present invention, the end closure flaps, which are of conventional seal end configuration, are provided with mating ridges and grooves of the type previously described; and additionally the corner edges of the innermost flaps are debossed to provide what may be characterized as troughs which are adapted to hold increments of adhesive which will effectively close and seal the corners of the carton.

Preferably the debossed areas will be of generally triangular configuration and will connect with the innermost groove formed in each of the flaps, the grooves thereby providing channels which will assist to direct the adhesive into the troughs as the closure flaps are infolded and sealed together. With the arrangement just described, conventional techniques may be utilized to close and seal the end closure flaps, including the use of conventional adhesive applicators to apply a thin layer of adhesive to the portions of the end closure flaps being secured together. No particular precautions need be taken to insure that the troughs will be filled with adhesive since, in accordance with the invention, sufficient adhesive will be displaced into the troughs as an incident of closing and sealing the closure flaps. It has been found that an adhesive layer of conventional thickness, such as several mils, provides ample adhesive to fill the troughs as the flaps are pressed into sealing engagement with each other. In fact, sufficient pressure is exerted at the corners of the carton to cause some of the adhesive to be forced into the interstices themselves, thereby effective plugging the interstices as well as providing plugs of adhesive in the areas of the troughs.

In a modification of the invention, mating debossed areas may be provided in the third to be infolded closure flap which overlies and is directly secured to the innermost closure flaps, such mating debossed areas preferably being of a size such that they will tend to enter into the troughs formed in the underlying inner closure flaps, thereby exerting additional pressure on the adhesive in the troughs to more effectively force some of the ahdesive into the interstices.

DESCRIPTION OF THE DRAWINGS

FIG. 6 is an enlarged fragmentary vertical sectional view illustrating a corner of the closed and sealed end closure.

DESCRIPTION OF THE PREFERRED EMBODIMENT

Figure 1:
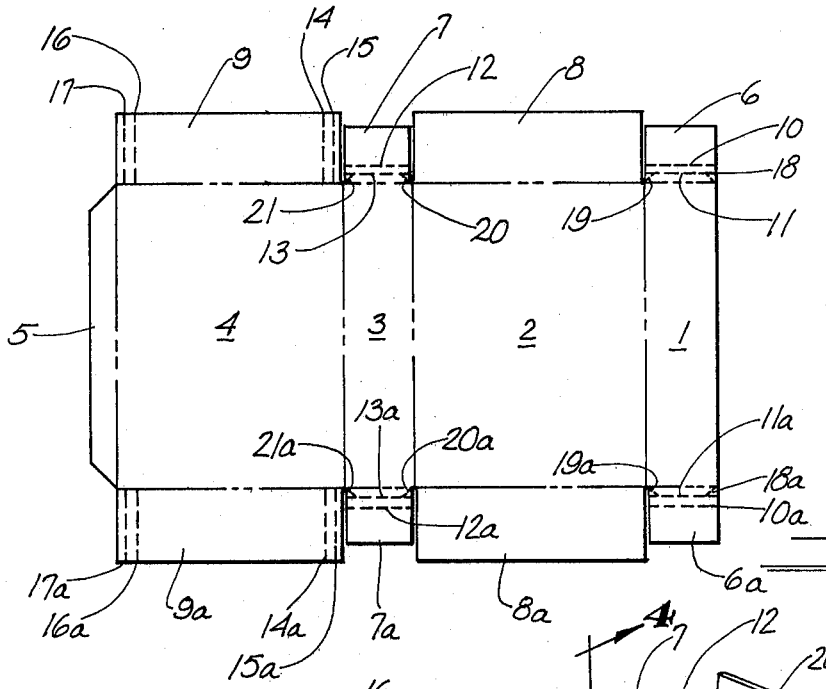
FIG. 1 is a plan view of a carton blank embodying end closures constructed in accordance with the invention.

Referring first to FIG. 1 of the drawings which illustrates a carton blank having end closures formed in accordance with the invention, the blank comprises a series of body wall panels 1, 2, 3 and 4 in side-by-side articulation in the order named, a longitudinal glue flap 5 being hingedly connected to the outermost side edge of body wall panel 4. In the embodiment illustrated the top and bottom end closures are identical, comprising sets of inner or first folded end closure flaps 6, 7 and *6a*, *7a*, together with intermediate closure flaps 9 and *9a*, and outer closure flaps 8 and *8a*. The latter sets of closure flaps are full-width flaps in that they are each of a length and depth to span the ends of the carton body. The depth of the sets of flaps 6, 7 and *6a*, *7a* may be the same as the other sets of flaps, or, as illustrated, they may be somewhat shorter, depending upon the dimensions of the carton. The carton blank thus far described is of conventional construction.

In accordance with the invention, inner closure flaps 6 and 7 are provided with sets of score lines formed by scoring rules adapted to contact and score the outermost surfaces of the flaps, i.e., the scoring rules contact and indent or deboss the flaps from their outermost surfaces, the score lines resulting in recesses or grooves in the outermost surfaces of the flaps and corresponding ridges on their innermost surfaces. Thus, inner closure flaps 6 and 7 are provided with sets of score lines 10, 11 and 12, 13, respectively; and similarly closure flaps 6*a* and 7*a* are provided with sets of score lines 10*a*, 11*a* and 12*a*, 13*a*, respectively. These score lines extend the full length of each of the flaps, preferably lying in spaced relation to each other near the base edge of each flap. Intermediate closure flap 9 is provided with coacting sets of score lines 14, 15 and 16, 17; and closure flap 9*a* is provided with similar sets of score lines 14*a*, 15*a* and 16*a*, 17*a*. These latter sets of score lines extend at right angles to the first sets of score lines, i.e., score lines 10, 11 and 12, 13, etc., and are positioned adjacent the opposite end edges of intermediate flap 9, their positioning being such that they will mate with the sets of score lines in the inner closure flaps when the flaps are infolded and sealed together. In addition, the inner closure flaps are provided adjacent their innermost ends with trough forming debossed areas 18, 19 and 20, 21, respectively; and comparable debossed areas 18*a*, 19*a* and 20*a*, 21*a* are formed in inner end closure flaps 6*a* and 7*a*, respectively. These debossed areas are also formed from the outer surface of the blank and hence the troughs defined by the debossed areas are formed in the outer surfaces of the flaps. The troughs are preferably of generally triangular configuration, each of the troughs having one of its side edges coinciding with the adjoining end edge of the closure flap. In addition, the troughs are in communication with the innermost score line in each flap. Thus, the troughs 18 and 19 communicate with score line 11; and like considerations apply to troughs 18*a*, 19*a*, 20, 21 and 20*a*, 21*a* and their adjoining score lines.

As now should be apparent, the conventional seal end blank is modified only by the addition of the mating sets of score lines in the inner closure flaps and in the intermediate closure flap, and the provision of debossed troughs at the innermost end edges of the inner sets of closure flaps. These score lines and debossed areas can be readily formed as an incident of the initial cutting and scoring of the carton blanks.

Figure 2:
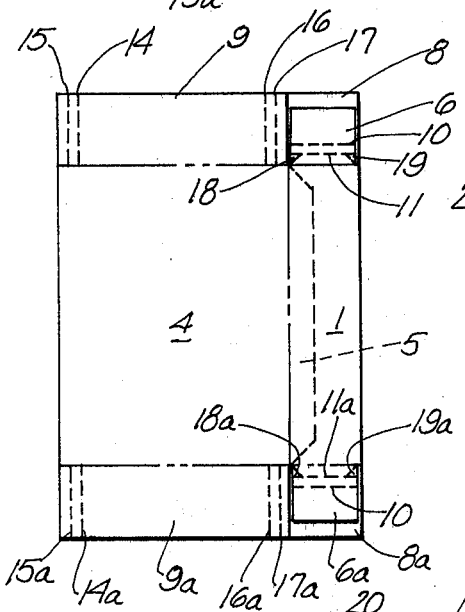
FIG. 2 is a plan view illustrating the blank of FIG. 1 in the knocked-down, flat-folded condition.
Figure 3:
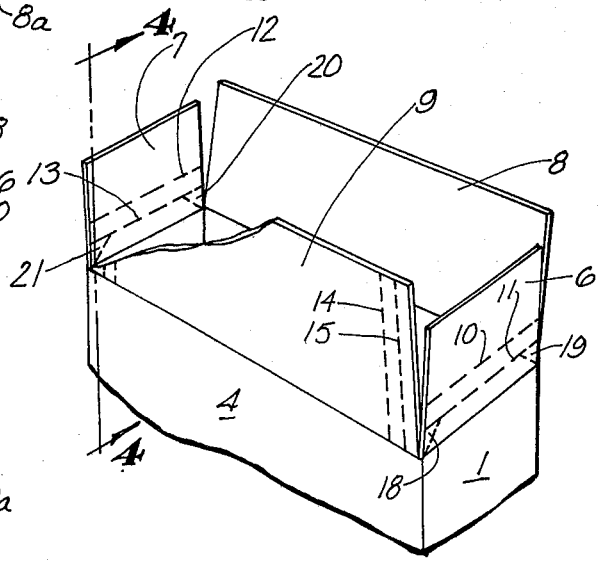
FIG. 3 is a partial perspective view of the carton in erected condition with the top closure flaps in extended position.
Figure 4A:
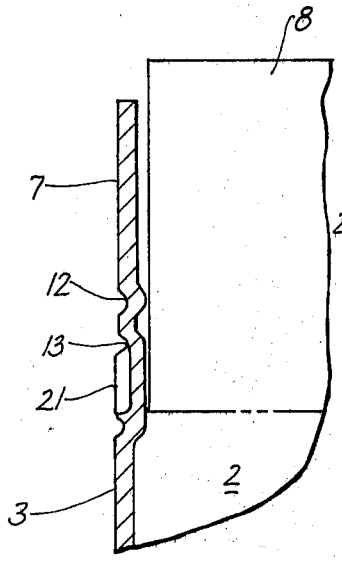
FIG. 4 is an enlarged fragmentary vertical sectional view taken along the line 4—4 of FIG. 3.
Figure 4B:
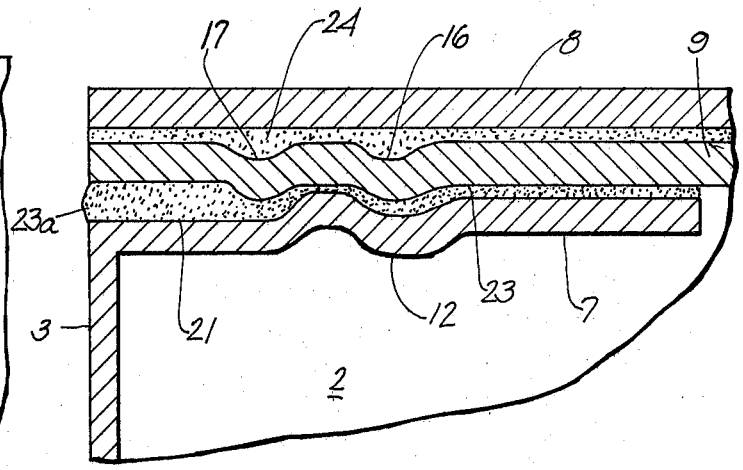

Once the blanks have been cut and scored to the condition illustrated in FIG. 1, they can be readily fabricated into knocked-down tubular cartons by infolding the parts to the condition illustrated in FIG. 2, with the interposition of adhesive between the longitudinal glue flap 5 and the overlying body wall panel 1. The cartons may be stored and shipped to the packager in the flat-folded condition. In the hands of the packager, the cartons may be erected or "squared-up" in conventional fashion, followed by the closing of the flaps at one end of the cartons, the filling of the cartons with the desired contents through their remaining open ends, and the subsequent infolding and gluing of the remaining closure flaps. The open upper end of the erected carton is seen in FIG. 3, and FIG. 4 illustrates in enlarged detail the manner in which the score lines 12 and 13 form grooves in the outer surface of inner closure flap 7, with the debossed area 21 forming a trough immediately adjacent the line of articulation between flap 7 and is underlying body wall 3. It is this trough, along with similar troughs formed at the innermost end edges of each inner closure flap, which are filled with adhesive when the flaps are infolded and sealed together.

Figure 5:
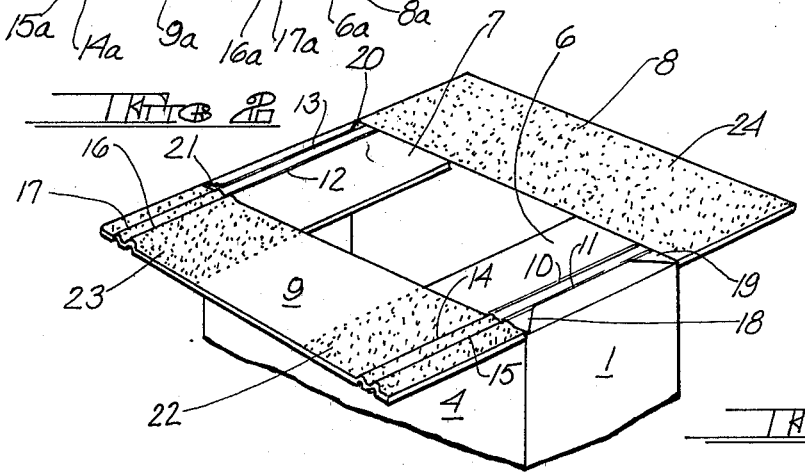
FIG. 5 is a fragmentary perspective view similar to FIG. 3 illustrating the initial infolding of the closure flaps and the application of adhesive thereto.

FIG. 5 illustrates the initial infolding of the inner closure flaps 6 and 7, together with the application of areas of adhesive 22 and 23 to the outfolded inner surface of intermediate closure flap 9, the adhesive areas being positioned to contact the uppermost outer surfaces of infolded inner closure flaps 6 and 7. Similarly, a thin layer of adhesive, indicated at 24, is applied to the out-folded inner surface of outer closure flap 8, which is the last to be infolded of the closure flaps.

When intermediate closure flap 9 is infolded and pressed into contact with the underlying closure flaps 6 and 7, followed by the infolding of outer closure flap 8, and the application of sealing pressure to the closed flaps, some of the adhesive making up areas 22 and 23 will be caused for flow into the troughs at the corners of the inner closure flaps. To this end, some of the migrating adhesive flows into the recesses defined by the score lines 11, 11*a* and 13, 13*a* of the inner sets of closure flaps, and since the score lines are in communication with the adjoining troughs, a squeezing action results which forces some of the adhesive in the recesses into the troughs. Thus, plugs of adhesive are formed at each corner of the end closure, one such plug being indicated at 23*a* in FIG. 6. In addition to filling the troughs, some of the adhesive is forced into the "pin-holes" or intersitces formed as the flaps are infolded, the particular areas of concern being at the junctures of the innermost end edges of the closure flaps with their underlying body walls. In this connection, and with reference to FIG. 5, it will be evident that the troughs 18 and 21 each has a side edge lying along the innermost end edges of intermediate closure flap 9, and consequently the plugs of adhesive formed in the troughs will effectively seal any opening which might be formed between the end edges of inner flaps 6 and 7 and closure flap 9 when the latter is infolded. Similarly, the adhesive plugs formed in troughs 19 and 20 provide effective protection at the opposite corner edges of the carton where the troughs abut against the corner edges of outer flap 8, again serving to provide adhesive plugs which will close and seal the opposite corner edges of the carton.

Figure 7:
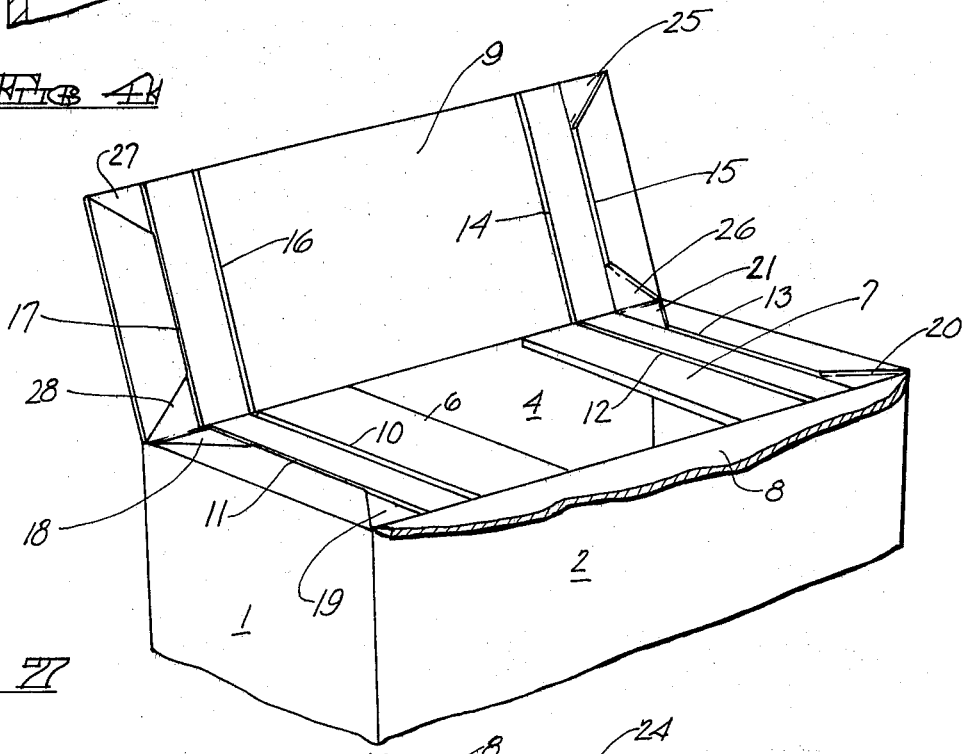
FIG. 7 is a fragmentary perspective view illustrating a modification of the invention wherein mating troughs are formed in the third closure flap.

While the pressure exerted on the adhesive during infolding and sealing of the closure flaps is effective to force the adhesive into the troughs as well as into any interstices which might develop, additional adhesive plugs may be provided at the corners of the carton by providing mating debosssed areas in intermediate closure flap 9. Thus, as seen in FIG. 7, debossed areas 25, 26, 27 and 28 are formed at the corners of intermediate closure flap 9, the debossed areas being of a size to mate with the corresponding debossed areas at the corner edges of inner closure flaps 6 and 7. The debossed areas 25 and 26 communicate with the groove forming side of score line 15, and debossed areas 27 and 28 communicate with the groove forming side of score line 17.

Figure 8:
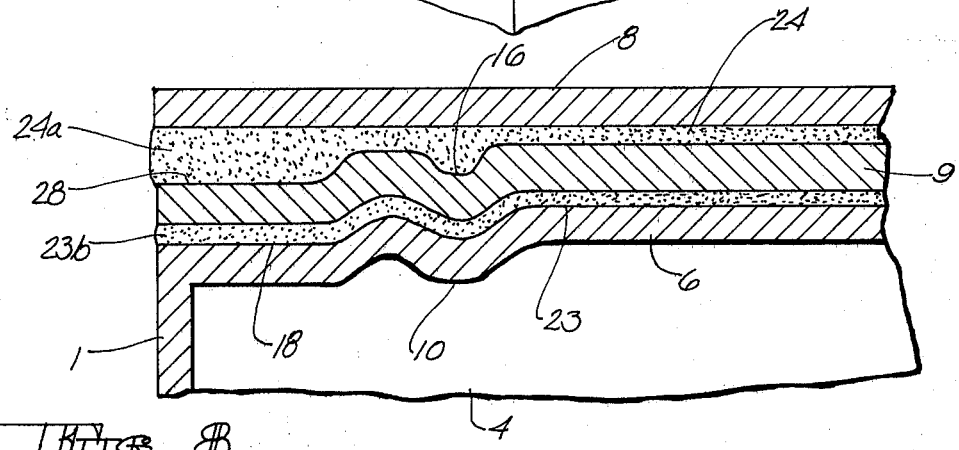
FIG. 8 is an enlarged fragmentary vertical sectional view illustrating a corner of the closed and sealed end closure of FIG. 7.

Adhesive will be applied to the inner surfaces of flaps 8 and 9 in the same manner as illustrated in FIG. 5, whereupon the flaps will be infolded and pressure applied to seal them together. When intermediate flap 9 is juxtaposed to innermost flaps 6 and 7, the debossed areas 26 and 28 will seat in the underlying debossed areas 21 and 18, respectively; and debossed areas 25 and 27 will seat in debossed areas 20 and 19, respectively. At the same time, the debossed areas 25–28 define adhesive receiving troughs in the upper or outer surfaces of intermediate closure flap 9, and as will be readily apparent from FIG. 8, the debossed area 28 will have seated in underlying debossed area 19, and while the nesting of debossed areas 28 and 29 will reduce the thickness of the adhesive plug **23*b* formed in trough 18, the debossed area 28 will form an additional trough facing outer closure flap 8 into which adhesive will be forced as sealing pressure is applied to the closure flaps, thereby forming a second adhesive plug 24*a***. The net effect is to provide increased increments of adhesive at the corners of the carton which effectively close and seal any minute openings which might otherwise exist.

Modifications may be made in the invention without departing from its spirit and purpose. For example, while debossed areas of triangular configuration are preferred, the debossed areas could be of other configurations, such as square or rectangular. While it is preferred that the mating score lines in the intermediate closure flap nest with the score lines in the inner closure flaps which communicate with the trough forming debossed areas, if additional sets of score lines are employed to form multiple barriers, they need not nest but can be in interdigitating relation, the essential requisite being that the score lines will coact to define barriers which will resist the shifting and leakage of the packaged materials. Other modifications will undobutedly occur to the worker in the art upon reading this specification, and accordingly it is not intended that the invention be limited other than the manner set forth in the claims which follow.

The embodiments of the invention in which an exclusive property of privilege is claimed are defined as follows:

1. An end closure for a paperboard carton having four enclosing body walls, a pair of inner closure flaps hingedly connected to the end edges of an opposing pair of said body walls, an intermediate closure flap hingedly connected to the end edge of a third of said body walls, and an outer closure flap hingedly connected to the end edge of the fourth body wall, at least one score line formed in each of said inner closure flaps extending in parallel spaced relation to the end edges of the body walls to which said inner closure flaps are hingedly connected, said score lines defining grooves in the outer surfaces of said flaps and corresponding ridges on the inner surfaces of said flaps, debossed areas extending from the outer ends of said score lines to the inner corner edges of said inner closure flaps, said debossed areas defining troughs in the outer surfaces of said inner closure flaps in communication with the grooves defined by said score lines having edges coinciding with the end edges of said inner closure flaps, mating score lines in said intermediate flap positioned to mate with the score lines in said inner closure flaps when the carton is closed, whereby when the flaps are infolded with a thin layer of adhesive interposed between said intermediate closure flap and said inner closure flaps and sealing pressure applied to the flaps, increments of the adhesive will be forced into the troughs to form plugs of adhesive which close and seal the corner edges of the end closure.

2. The end closure claimed in claim 1 wherein said debossed areas are of triangular configuration and have a second side edge coinciding with the score lines in said inner closure flaps.

3. The end closure claimed in claim 2 wherein said mating score lines define grooves in the outer suurface of said intermediate closure flap and corresponding ridges on the inner surface thereof.

4. The end closure claimed in claim 3 wherein pairs of spaced apart score lines are formed in each of said inner closure flaps, and wherein pairs of mating score lines are formed in said intermediate flap in positions to mate with the pairs of score lines in said inner closure flaps.

5. The end closure claimed in claim 1 wherein said mating score lines defining grooves in the outer surface of said intermediate closure flap and corresponding ridges on the inner surface thereof, and wherein additional debossed areas are formed in said intermedite closure flap extending from the outer ends of said mating score lines to the adjoining corner edges of said intermediate flap, said additional debossed areas defining troughs in the outer surface of said intermediate flap in communication with the grooves defined by said mating score lines, whereby when the flaps are infolded with the interposition of a thin layer of adhesive between said intermediate and outer closure flaps and sealing pressure applied to the flaps, increments of adhesive will be forced into the troughs at the corners of said intermediate flap to form additional plugs of adhesive to seal the corner edges of the end closure.

6. The end closure claimed in claim 5 wherein the additional embossed areas in said intermediate closure flap are of a size to mate with the debossed areas in said inner closure flaps.

7. The end closure claimed in claim 6 wherein all of said debossed areas are of triangular configuration.

* * * * *